US007093310B2

(12) United States Patent
Barros

(10) Patent No.: US 7,093,310 B2
(45) Date of Patent: Aug. 22, 2006

(54) BEDDRESS

(75) Inventor: Eurides Barros, Milton, MA (US)

(73) Assignee: Miranda Industries, Inc., Dorchester, MA (US)

( * ) Notice: Subject to any disclaimer, the term of this patent is extended or adjusted under 35 U.S.C. 154(b) by 0 days.

(21) Appl. No.: 11/028,375

(22) Filed: Jan. 3, 2005

(65) Prior Publication Data

US 2006/0143826 A1 Jul. 6, 2006

(51) Int. Cl.
*A47G 9/02* (2006.01)

(52) U.S. Cl. ..... 5/482; 5/493

(58) Field of Classification Search ..... 5/482, 5/486, 493, 495–499
See application file for complete search history.

(56) References Cited

U.S. PATENT DOCUMENTS

| | | | | |
|---|---|---|---|---|
| 796,722 | A * | 8/1905 | Hermann | 5/499 |
| 2,139,698 | A * | 12/1938 | Schreiber | 5/1 |
| 2,641,001 | A * | 6/1953 | Krasnov | 5/499 |
| 3,621,498 | A * | 11/1971 | Cooper | 5/174 |
| 4,402,098 | A * | 9/1983 | McClam | 5/494 |
| 4,734,947 | A * | 4/1988 | Vitale | 5/493 |
| 4,807,316 | A * | 2/1989 | Whipple | 5/493 |
| 5,353,456 | A | 10/1994 | Evans | |
| 5,483,712 | A | 1/1996 | Greenwood | |
| 5,549,355 | A | 8/1996 | Illulian | |
| 5,621,931 | A | 4/1997 | Hamilton | |
| 5,638,562 | A | 6/1997 | Masoncup | |
| 5,704,082 | A | 1/1998 | Smith | |
| 5,715,553 | A | 2/1998 | Baron et al. | |
| 5,749,110 | A | 5/1998 | Gamble et al. | |
| 5,794,285 | A | 8/1998 | Burch | |
| 5,802,637 | A | 9/1998 | Bordo | |
| 5,836,023 | A | 11/1998 | Munson | |
| D411,932 | S | 7/1999 | McClendon | |
| 5,946,751 | A | 9/1999 | DeMay | |
| 5,966,758 | A | 10/1999 | Karam | |
| 6,035,469 | A | 3/2000 | Schrougham | |
| 6,044,503 | A | 4/2000 | McClendon | |
| 6,105,186 | A | 8/2000 | Munson | |
| 6,119,290 | A | 9/2000 | Masoncup | |
| 6,243,895 | B1 | 6/2001 | Amin | |
| 6,276,009 | B1 | 8/2001 | Schrougham | |
| 6,398,301 | B1 | 6/2002 | Illulian | |

FOREIGN PATENT DOCUMENTS

CA 2189485 7/1998

OTHER PUBLICATIONS

Quickskirt® Dust Ruffle by United Feather and Down, as sited in http://www.bedbathandbeyond.com/product.asp?order_num=-1&SKU=104848, Dec. 27, 2004.

Grip Deck Detachable Bedskirt System, as sited in http://www.gripdeck.com/, Dec. 27, 2004, Sweet Dreams West, Inc., Tucson, AZ.

(Continued)

*Primary Examiner*—Michael Trettel
(74) *Attorney, Agent, or Firm*—Wilmer Cutler Pickering Hale and Dorr LLP

(57) ABSTRACT

A beddress. Under one embodiment, a beddress includes an upper fabric portion sized and shaped to cover an upper surface of a top mattress structure and a lower fabric portion sized and shaped to cover at least three side surfaces of a bottom mattress structure. The upper and lower fabric portions are securably coupled together at an interface so that the coupled portions are installable over the top mattress structure as a unitary covering. The interface is positioned to fit between the top and bottom mattress structures.

5 Claims, 9 Drawing Sheets

OTHER PUBLICATIONS

Bed Bra™, as sited in http://www.bedbra.com/index.html, Dec. 27, 2004, Las Vegas, NV.
Quickskirt® Dust Ruffle by United Feather and Down, as sited in http://www.bedbathandbeyond.com/product.asp?order_num=-1&SKU=104848, Dec. 27, 2004.
Grip Deck Detachable Bedskirt System, as sited in http://www.gripdeck.com/, Dec. 27, 2004, Sweet Dreams West, Inc., Tucson, AZ.
Bed Bra™, as sited in http://www.bedbra.com/index.html, Dec. 27, 2004, Las Vegas, NV.

* cited by examiner

BEDDRESS

BACKGROUND

1. Technical Field

The present invention relates generally to a beddressing structure for placement as a single piece over a mattress of a bed and which is sized and shaped to decoratively cover exposed portions of the box spring.

2. Discussion of Related Art

Conventional dust ruffles for beds comprise a ruffled type skirt (also called a bedskirt) that is sized to be placed over a box spring of a bed. In order to install, remove, or adjust a conventional dust ruffle from a bed, one must generally remove the upper mattress, which is difficult because of its weight and bulk.

FIG. 1 is an exploded perspective view of a two-piece mattress set (e.g., a mattress 5 and box spring 3). Dust ruffle 1 has a decorative skirt 7 and may be placed over the box spring 3 so that it may drape downward, as shown in FIG. 2, to cover otherwise exposed portions of the box spring.

U.S. Pat. No. 6,119,290 discloses a dust ruffle structure. The dust ruffle structure is sized and shaped to be positioned on and arounds a lower supporting structure (e.g., box spring) and underneath an upper mattress. The dust ruffle includes a friction fastening structure.

U.S. Pat. No. 5,638,562 discloses a bed cover structure with an improved dust ruffle. A fitted bed sheet foundation extends downwardly below and alongside the mattress with a lowermost edge area of the sheet positioned in confronting relation to a box spring, and having a first fastener secured at the lowermost edge of the sheet. The dust ruffle, among other things, includes a second fastener at the upper edge of a band of material on the dust ruffle so that it is securable to the first fastener.

SUMMARY OF THE INVENTION

The invention provides a beddress.

According to one aspect of the invention, a beddress includes an upper fabric portion sized and shaped to cover an upper surface of a top mattress structure and a lower fabric portion sized and shaped to cover at least three side surfaces of a bottom mattress structure. The upper and lower fabric portions are securably coupled together at an interface so that the coupled portions are installable over the top mattress structure as a unitary covering. The interface is positioned to fit between the top and bottom mattress structures.

According to another aspect of the invention, the upper and lower fabric portions are coupled with elastic joinery.

DETAILED DESCRIPTION

Preferred embodiments of the invention provide a "beddress" that is sized and shaped to fit over an upper mattress and extend past or wrap under a lower mattress structure (e.g., a box spring structure). The beddress is easy to install and retains its position largely as a function of its being placed over the upper mattress structure. "Fine tuning" of position may be achieved by tucking some material between the upper and lower mattress structures. This may be considered tucking in the "waist" or midriff of the beddress. However, such tucking is not needed to install the beddress and the upper mattress need not be lifted or removed to install the beddress. In this regard, the nomenclature of "beddress" is significant and intended to convey the idea of one installable article covering a top and bottom mattress structure, as opposed to a bed "skirt" or dust ruffle or decorative covering, which just covers the bottom. In practice, the beddress could subsequently be covered with a fitted sheet or the like over the upper mattress structure.

Figure 1:
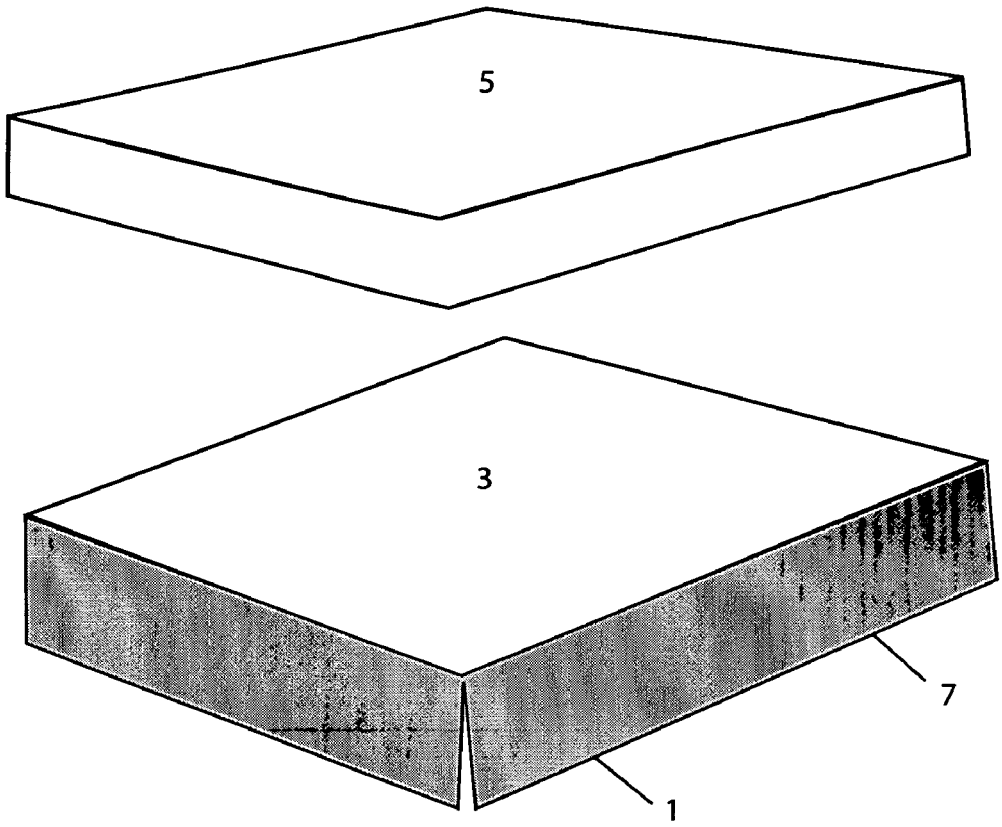
FIG. 1 is an exploded perspective view of an upper and lower bed structure and a prior art dust ruffle.
Figure 2:
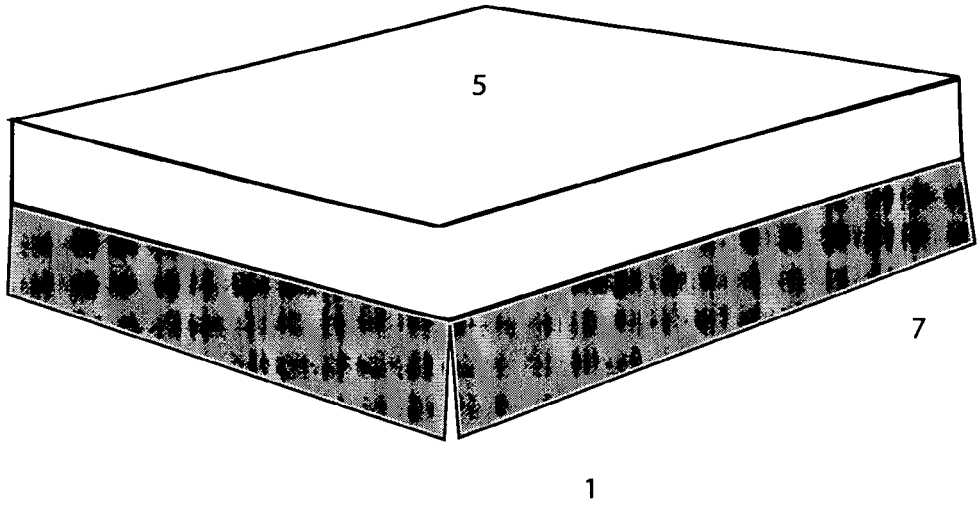
FIG. 2 is a perspective view of an upper and lower bed structure and a prior art dust ruffle.
Figure 3:
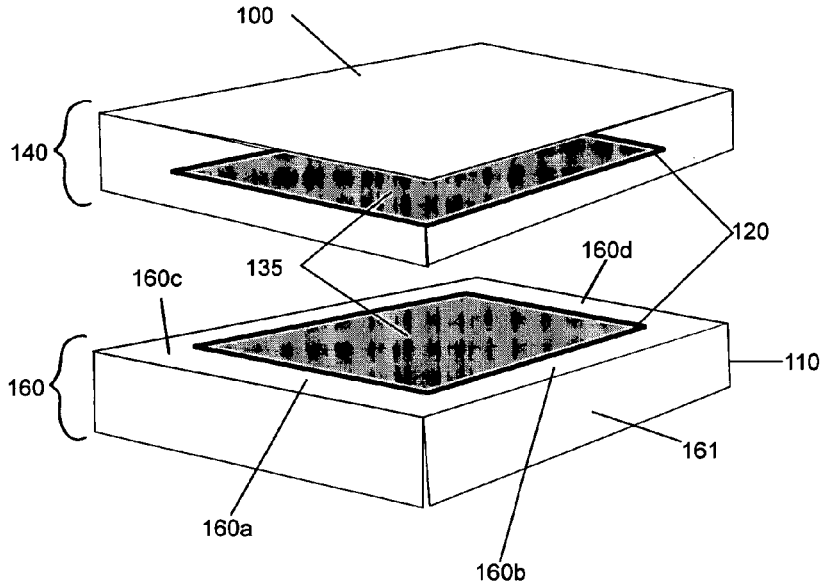
FIG. 3 is an exploded perspective view of a two piece mattress set and an exploded view of a beddress according to certain embodiments of the invention.
Figure 4:
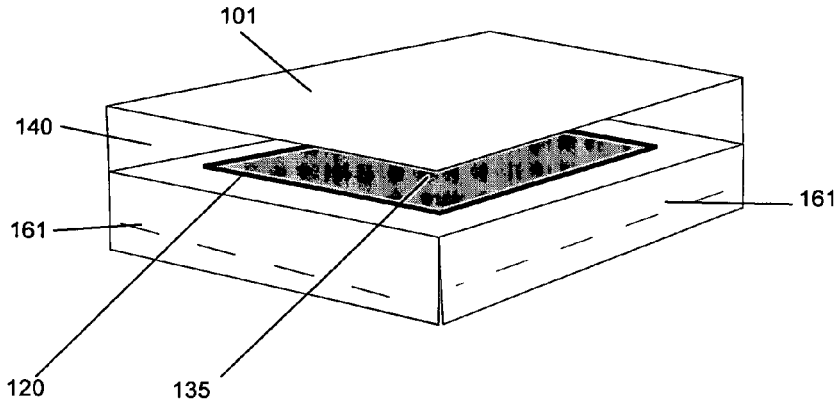
FIG. 4 is a perspective view of a two piece mattress set and a beddress according to certain embodiments of the invention.

FIG. 3 is an exploded perspective view and FIG. 4 is an assembled perspective of an upper and lower mattress structures 100, 110 and a beddress 101. In FIG. 3, the beddress, for descriptive purposes, is shown as if it were separated into two portions 140,160. The upper portion 140 and lower portion 160 are coupled or joined at an interface 120, which in one embodiment may be formed as an elastic strip commonly joined or attached to the upper and lower portions to form one beddress 101. The portions are formed to define openings 135.

The beddress 101, and specifically upper portion 140, covers the upper mattress 100 in a way analogous to a fitted sheet. Lower portion 160, in this embodiment, includes decking sections 160*a–d* (shown better in other figures) and decorative covering or skirting 161 that drapes down past the lower mattress structure 110 (shown in hidden view under lower structure 110 with dashed lines).

Figure 5:
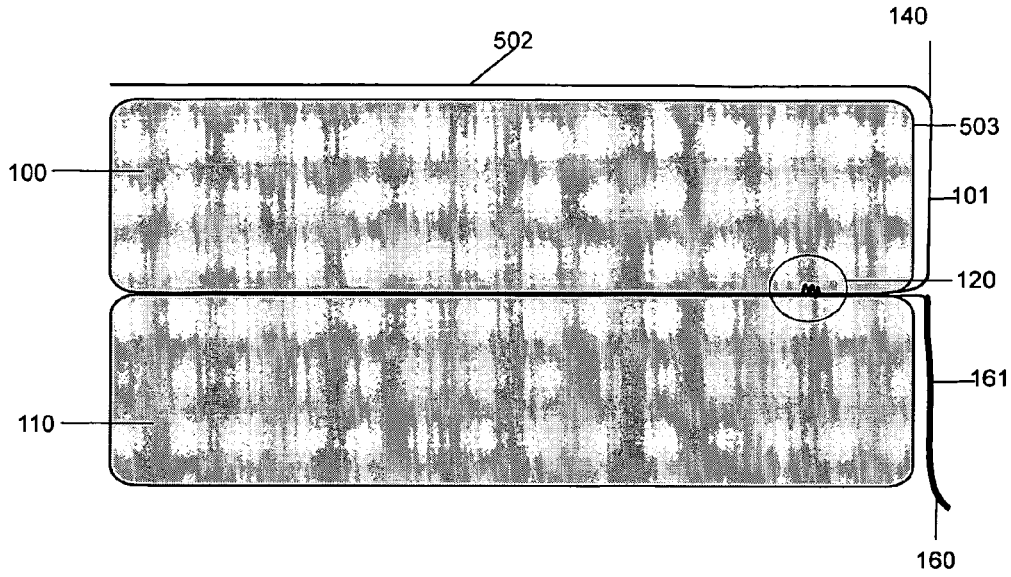
FIG. 5 is a cross-sectional view of an assembled two piece mattress set and a beddress according to certain embodiments of the invention.
Figure 6:
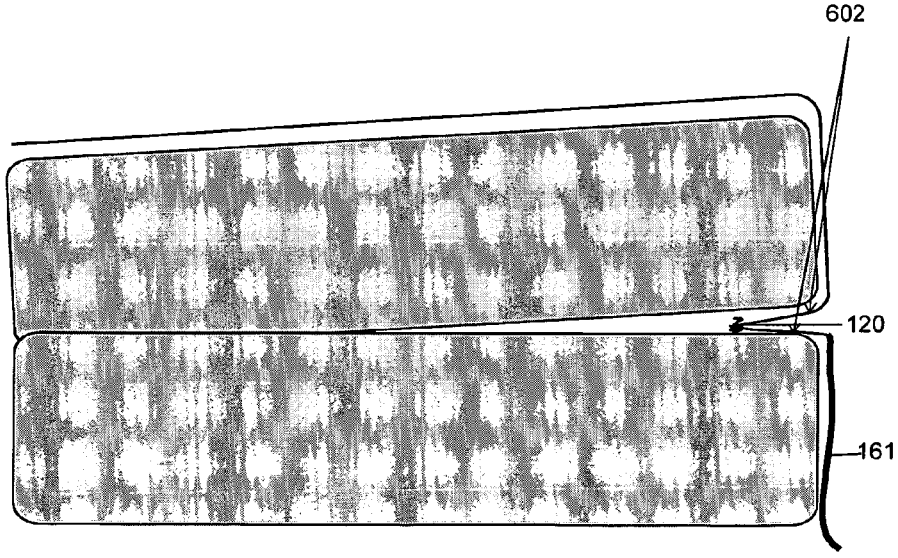
FIG. 6 is a cross-sectional view of a two piece mattress set and a beddress according to certain embodiments of the invention.

FIG. 5 is a cross-sectional view of the upper and lower mattress structures 100,110 and beddress 101 of FIG. 4. FIG. 6 is the same cross-sectional view but with the upper mattress 100 shown slightly elevated for descriptive purposes and to illustrate waist section 602. As seen in these figures, an upper surface 502 of upper portion 140 covers a top surface of the top mattress 100. The upper portions 140 wraps around the side surfaces 503 of the mattress and slightly under the mattress 100. A waist portion 602 of the beddress 101 includes the decking sections 160*a–d* (shown in FIG. 3 and elsewhere) and corresponding decking sections of the top portion, with these portions being joined at interface 120. The waist may be tucked between the upper and lower mattress structures 100, 110. The lower portion 160 includes decorative skirting 161 which may drape down to cover the otherwise exposed side surfaces of the lower mattress 110.

Figure 7:
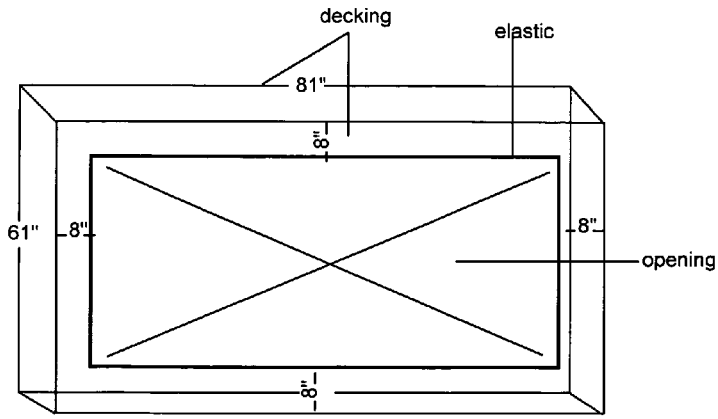
FIG. 7 is a fabric pattern of certain embodiments.
Figure 8:
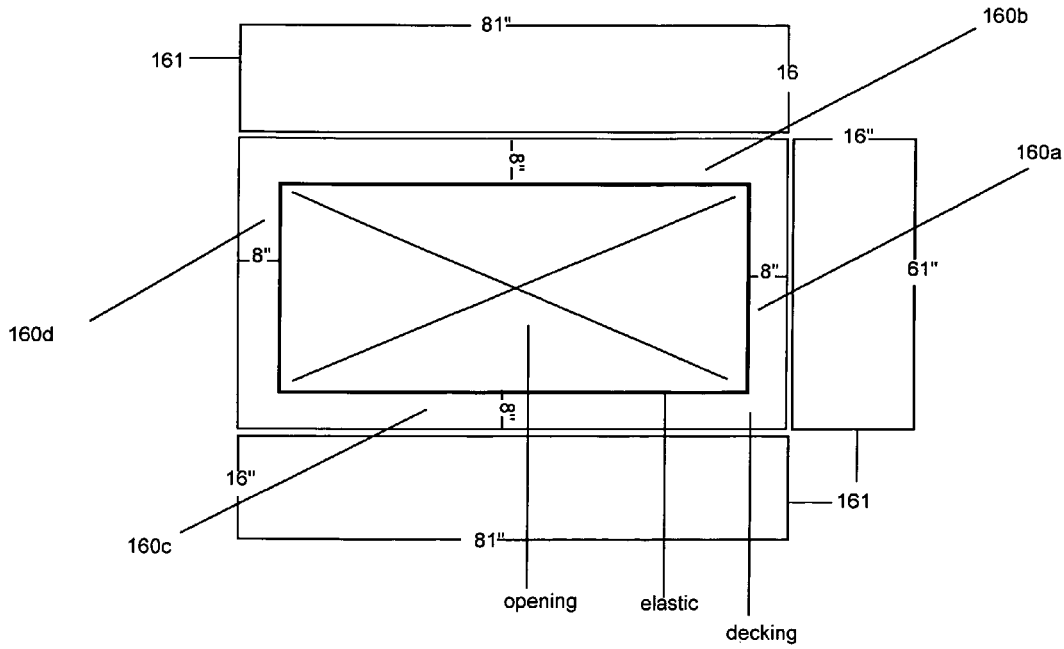
FIG. 8 is a fabric pattern of certain embodiments.

FIG. 7 is a fabric pattern of an upper portion 140 and FIG. 8 is a fabric pattern for a lower portion 160 according to certain embodiments. The dimensions are shown in inches for a "queen size" version and essentially any material may be used for the decking or decorative skirting. In this embodiment, the decorative skirting 161 extends for only three of four sides.

While certain embodiments have the first and second portions fixed securely to one another at interface 120 via conjoined elastic, other securing mechanisms and approaches may be used, e.g., zippers, tapes, hooks, direct stitching, etc. The objective is to create a sufficient joining so that the two portions may be handled and installed over the mattress structures 100,110 as one piece.

Figure 9:
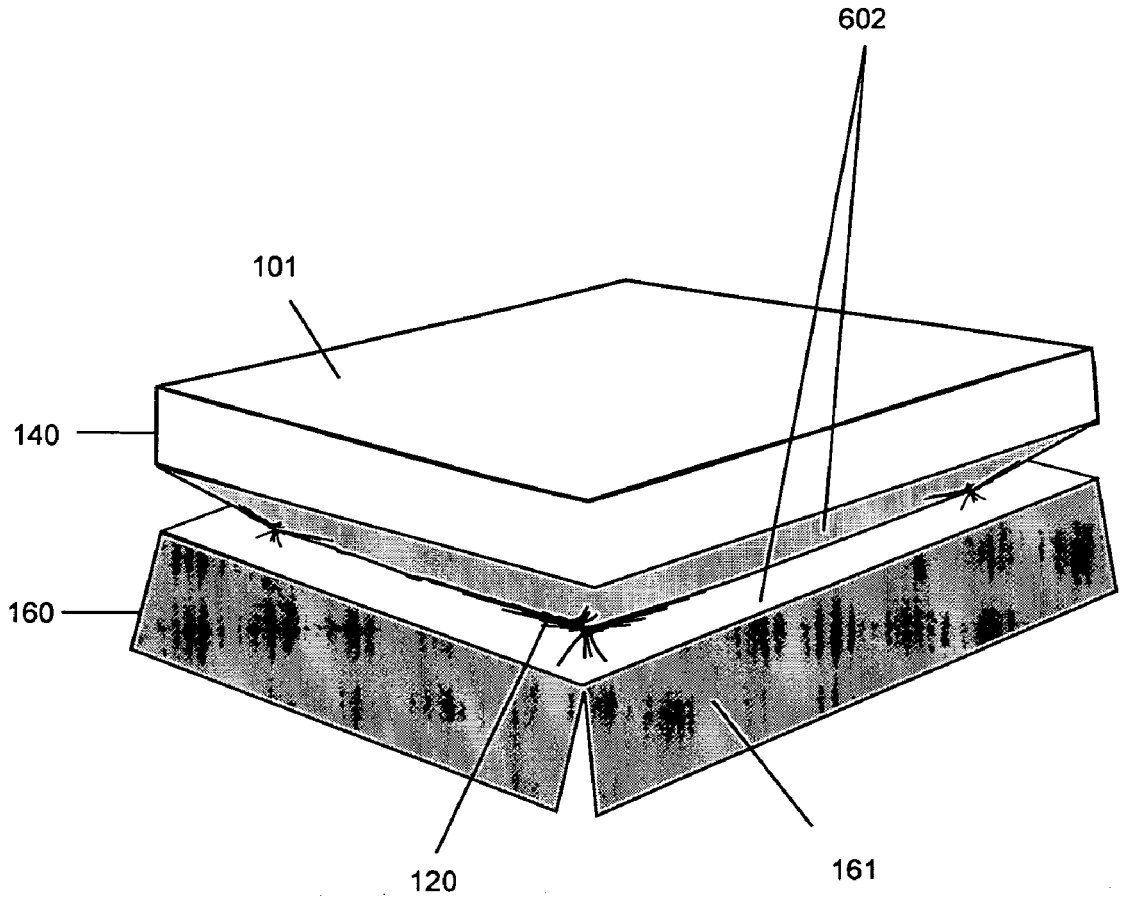
FIG. 9 is a perspective view of a two piece mattress set, having a beddress according to certain embodiments of the invention.

FIG. 9 is a perspective view of an assembled two-piece mattress set having the beddress 101 installed. As depicted, upper mattress 100 is elevated from the lower mattress for descriptive purposes to show the waist portion 602 and interface 120. Though many styles fall within the scope of the present embodiment, decorative skirt 161 is illustrated as flat and falling past the lower boundary of the lower mattress structure 110.

Figure 10:
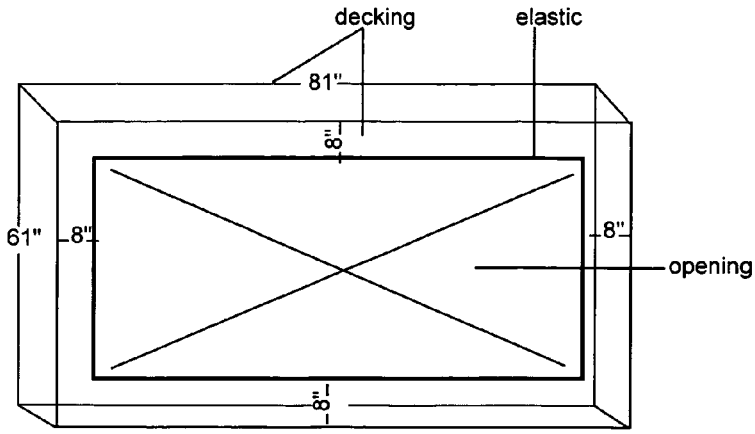
FIG. 10 is a fabric pattern of certain embodiments.
Figure 11:
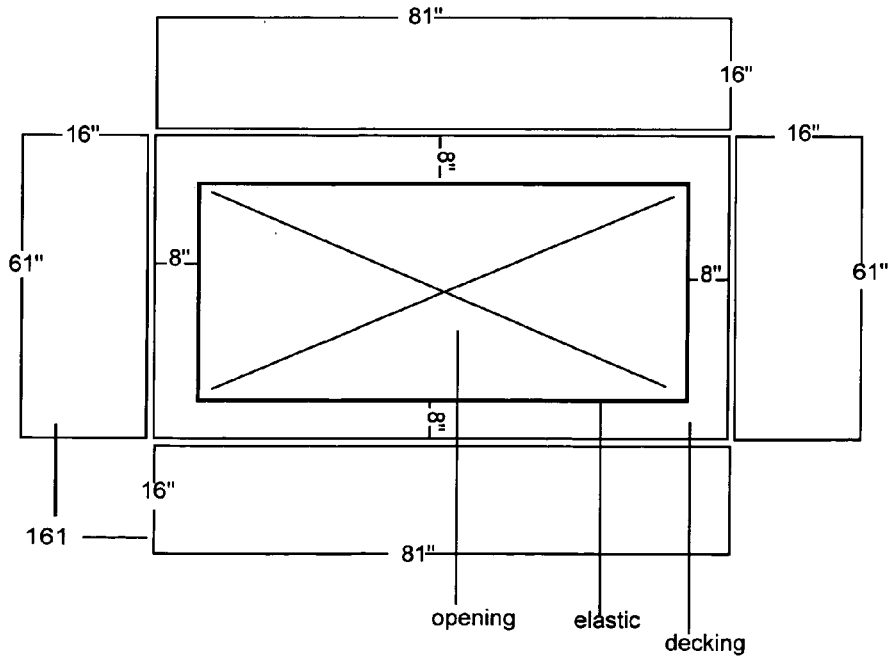
FIG. 11 is a fabric pattern of certain embodiments.

FIG. 10 is a fabric pattern of an upper portion 140 and FIG. 11 is a fabric pattern for a lower portion 160 according to other embodiments. The dimensions are shown in inches for a "queen size" version and essentially any material may be used for the decking or decorative skirting. In this embodiment, the decorative skirting extends for four sides and gathers under the box spring.

Figure 12:
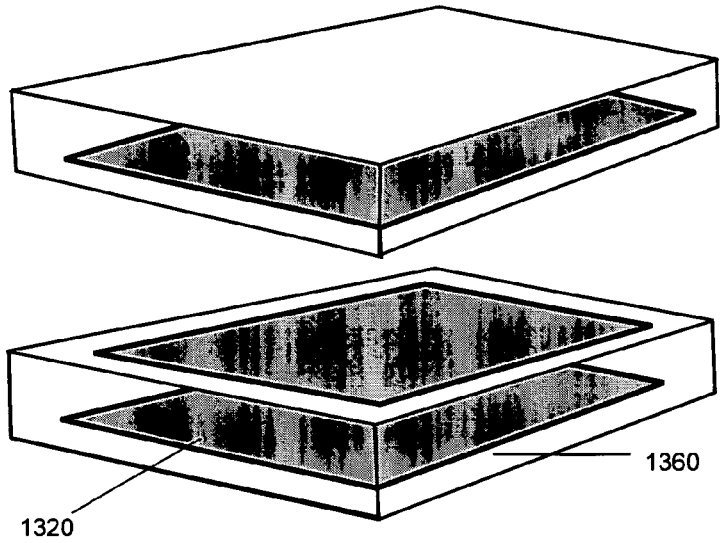
FIG. 12 is an exploded perspective view of a two piece mattress set and an exploded view of a beddress according to certain embodiments of the invention.
Figure 13:
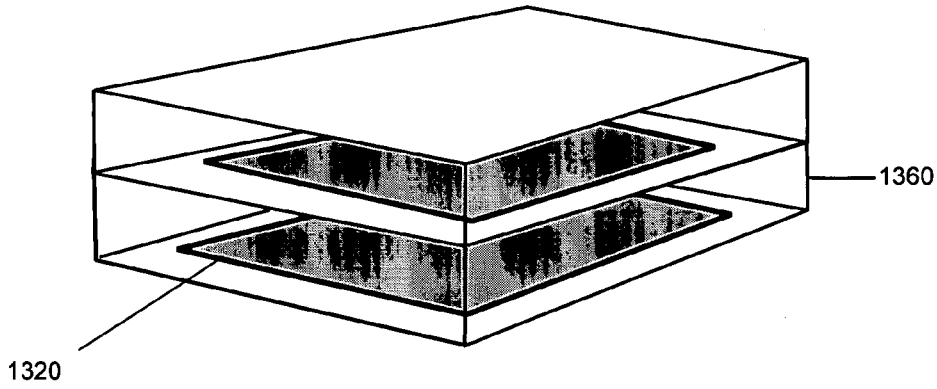
FIG. 13 is a perspective view of a two piece mattress set and a beddress according to certain embodiments of the invention.
Figure 14:
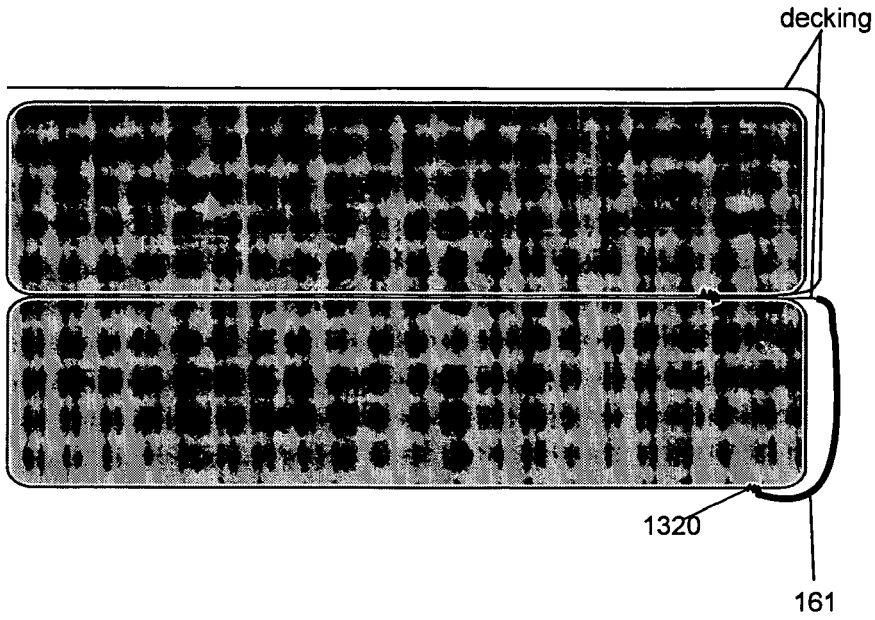
FIG. 14 is a cross-sectional view of an assembled two piece mattress set and a beddress according to certain embodiments of the invention.
Figure 15:
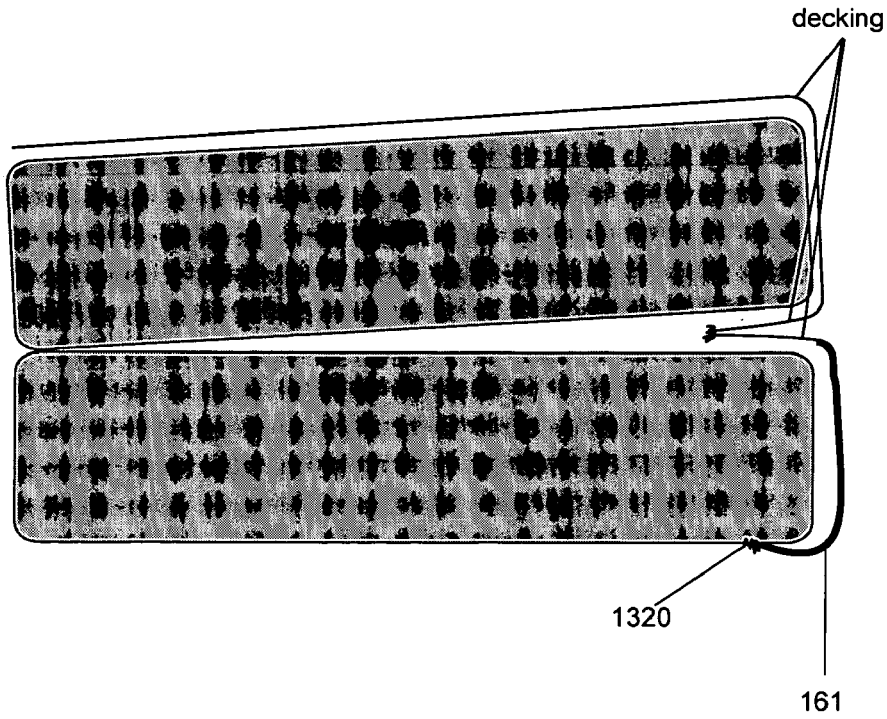
FIG. 15 is a cross-sectional view of a two piece mattress set and a beddress according to certain embodiments of the invention.

FIGS. 12 and 13 are similar to FIGS. 3 and 4 but for a different embodiment in which the lower portion is fitted. Cross sectional views of this embodiment are shown in FIGS. 14 and 15. These embodiments have a lower portion 1360 which fits and wraps around the lower mattress structure with another elastic 1320 for the lower surface of the lower mattress structure 110.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. A beddress, comprising an upper fabric portion sized and shaped to cover an upper surface of a top mattress structure;

a lower fabric portion sized and shaped to cover at least three side surfaces of a bottom mattress structure;

wherein the upper and lower fabric portions are securably coupled together at an interface and having conjoined elastic so that the coupled portions are installable over the top mattress structure as a unitary covering, and wherein the interface is positioned to fit between the top and bottom mattress structures.

2. The beddress of claim 1 wherein the upper and lower fabric portions are coupled with elastic joinery.

3. The beddress of claim 1 wherein the lower portion covers four side surfaces of the bottom mattress structure.

4. The beddress of claim 1 wherein the lower fabric portion includes decorative skirting.

5. The beddress of claim 1 wherein the lower fabric portion is a fitted covering.

* * * * *